US008453859B2

(12) United States Patent
Rozenberg

(10) Patent No.: US 8,453,859 B2
(45) Date of Patent: Jun. 4, 2013

(54) TAMPER-EVIDENT BOTTLE CLOSURE

(76) Inventor: Tzvi Akiva Rozenberg, Jerusalem (IL)

( * ) Notice: Subject to any disclaimer, the term of this patent is extended or adjusted under 35 U.S.C. 154(b) by 335 days.

(21) Appl. No.: 12/874,445

(22) Filed: Sep. 2, 2010

(65) Prior Publication Data

US 2011/0056904 A1 Mar. 10, 2011

Related U.S. Application Data

(60) Provisional application No. 61/239,802, filed on Sep. 4, 2009.

(51) Int. Cl.
*B65D 41/02* (2006.01)
*B65D 45/00* (2006.01)

(52) U.S. Cl.
USPC ..... 215/258; 215/274

(58) Field of Classification Search
USPC ..... 215/258, 252, 272, 274; 220/214
See application file for complete search history.

(56) References Cited

U.S. PATENT DOCUMENTS 4,343,408 A 8/1982 Csaszar
4,746,026 A * 5/1988 Leonhardt ..... 215/252
4,747,500 A 5/1988 Gach
5,462,181 A * 10/1995 Glynn ..... 215/204
5,813,553 A * 9/1998 Herr et al. ..... 215/252
5,927,529 A * 7/1999 Hofmann et al. ..... 215/223
5,971,188 A 10/1999 Kellogg
6,439,411 B1 * 8/2002 Schwarz ..... 215/252
6,769,557 B2 * 8/2004 Michael et al. ..... 215/204
7,040,499 B1 * 5/2006 Reif ..... 220/291
7,607,549 B2 * 10/2009 Morini ..... 215/297
2002/0166836 A1 * 11/2002 Moretti ..... 215/252
2003/0102281 A1 * 6/2003 Ryall et al. ..... 215/252
2004/0060891 A1 * 4/2004 Nishida ..... 215/252
2006/0113272 A1 * 6/2006 Rodriguez et al. ..... 215/252

* cited by examiner

*Primary Examiner* — Mickey Yu
*Assistant Examiner* — Niki Eloshway
(74) *Attorney, Agent, or Firm* — Roach Brown McCarthy & Gruber, P.C.; Kevin D. McCarthy

(57) ABSTRACT

A tamper-evident bottle closure has a ring element affixable to a bottle neck and a cap unit manufactured separately from the ring element and being coupled with the ring element externally to a bottle. The ring element of a coupled closure is affixable to a bottle neck prior to a first time opening of the bottle to retain a contained product in a confirmed sealed condition, yet the cap unit is irreversibly separable from the ring element when unscrewed for a first time to indicate that the bottle has been opened.

20 Claims, 6 Drawing Sheets

TAMPER-EVIDENT BOTTLE CLOSURE

This application claims priority from U.S. 61/239,802 filed on Sep. 4, 2009.

FIELD OF THE INVENTION

The present invention relates to the field of tamper-evident closures. More particularly, the invention relates to a tamper-evident bottle closure that also complies with the regulations of the Jewish Sabbath.

BACKGROUND OF THE INVENTION

Bottled products such as carbonated beverages require evidence whether the closure has been opened and whether the contents remains sealed. For example, a carbonated beverage bottle cap that is slightly opened can allow carbon dioxide to escape; so even while the cap safety ring has not been broken, the beverage may spoil even though there is no evidence of tampering.

Many tamper-evident closures are known from the prior art, such as U.S. Pat. No. 4,343,408, U.S. Pat. No. 4,747,500 and U.S. Pat. No. 5,971,188; however, all of these prior art closures comprise a frangible portion. U.S. Pat. No. 4,343,408, for example, discloses a one-piece closure including an end wall, an internally threaded upper portion and a depending lower skirt portion which includes an inwardly projecting bead adapted to engage the annular collar on the container. The depending lower skirt portion has a substantially uniform thickness throughout its entire area intended to contact the annular collar on the container, and the closure includes an area of weakness which is designed to fracture in a substantially horizontal plane across the closure. Fracture thus occurs when the closure is unthreaded from the container, thereby leaving the lower skirt portion engaged to the annular collar on the container after the end wall and internally threaded upper portion of the closure have been removed.

With respect to the prior art closures, the frangible portion fractures when a user unscrews the bottle closure for the first time, serving as visual evidence that the bottle has been opened. Such an arrangement is in violation of the Sabbath according to most authorities as the closure, after being unscrewed for the first time, has been effectuated into a usable tool which can be screwed again onto the bottle.

It is an object of the present invention to provide an anti-tamper bottle closure that complies with the regulations of the Jewish Sabbath.

Other objects and advantages of the invention will become apparent as the description proceeds.

SUMMARY OF THE INVENTION

Many internally threaded bottle caps have a tamper-evident connection formed between the bottle cap and bottle. When a user unscrews the bottle cap for the first time, a ring breaks away from the threaded bottle cap, serving as visual evidence that the bottle has been opened. Such an arrangement is in violation of the Sabbath according to most authorities as the cap, after being unscrewed for the first time, has been effectuated into a usable tool.

The present invention obviates this problem by providing a bottle closure comprising two separate components, a cap unit and a ring element, preventing the need to break or tear the cap unit from the ring element. Thus the unscrewing of the cap unit during a first time opening of the bottle, after the bottle closure has been threadedly engaged with the bottle neck and the ring element has been secured to the locking bead of the bottle neck, will not effectuate the cap element into a usable tool and will not violate the Sabbath since the cap unit has been able to seal a bottle neck after being manufactured.

The present invention provides a tamper-evident bottle closure complying with the regulations of the Jewish Sabbath, comprising a ring element affixable to a bottle neck having for example an annular locking bead and an annular flange located below said bead and extending radially outwardly from said bottle neck; and a cap unit manufactured separately from said ring element and which is coupled with said ring element externally to a bottle, wherein said ring element of a coupled closure is affixable to a bottle neck prior to a first time opening of the bottle to retain a contained product in a confirmed sealed condition, yet said cap unit is irreversibly separable from said ring element when unscrewed for a first time to indicate that the bottle has been opened.

As referred to herein, the relative positions of the bottle closure, or of the components thereof, such as "upper", "lower", "above", and "below" are described when a bottle is in a normal upright disposition such that the bottle neck is located above the base of the bottle and the closure is coupled to, or being coupled to, the bottle neck. However, the description is also applicable when a bottle or bottle closure is oriented in a different disposition.

In one aspect, the ring element, which is preferably made of a flexible material, is configured with an inner sloped wall and with a substantially horizontal surface that extends from an upper edge of said inner sloped wall, said inner sloped wall being slidable over the locking bead of a bottle neck when the coupled bottle closure is being lowered onto said bottle neck while the cap unit is being threadedly engaged with said bottle neck until said substantially horizontal surface of the ring element is in abutting relation with an underside of the bead. The ring element is in temporary fixed engagement with the locking bead when the substantially horizontal surface of the ring element is placed in abutting relation with the underside of the bead.

The ring element is movable between the bead and the flange after the cap unit has been unscrewed for the first time.

In one aspect, a maximum outer diameter of the ring element is greater than an inner diameter of a cap unit bottom surface. As the ring element can be coupled to the cap unit only externally to the bottle by suitable means such as compressing apparatus or heat applying means, and not when the ring element is affixed to the bottle neck, a loosely affixed ring element is indicative that that the bottle has been tampered with or has been opened.

In one aspect, the cap unit comprises a cap element and a sleeve element engaged with said cap element, the outer sloped wall of the ring element being engaged with an inner sloped wall of said sleeve unit.

In one aspect, the cap unit is also configured with a substantially horizontal surface inwardly extending from an upper edge of the inner sloped wall, said substantially horizontal surface being engageable with an upper surface of the ring element.

DETAILED DESCRIPTION OF PREFERRED EMBODIMENTS

The present invention is a novel tamper-evident bottle closure that comprises a ring element affixable to a bottle neck, and a separate cap unit, which is engaged with the ring element prior to a first time opening of the bottle to retain the contained beverage in a confirmed sealed condition, yet which is irreversibly separated from the ring element when unscrewed for the first time to indicate that the bottle has been opened.

Many prior art tamper-evident bottle closures comprise a frangible portion, which when fractured upon a first time opening of the bottle causes an upper cap portion to be detached from a lower skirt portion that remains engaged to the bottle neck. The detachment of the upper cap portion from the lower skirt portion positively indicates that the closure has been opened to allow the cap portion to be screwed again onto the bottle neck, thereby violating the regulations of the Sabbath which prohibit the effectuation of an unusable item into a usable tool. The cap element of the present invention, in contrast, is manufactured as a product distinct from the ring element and therefore can function to seal a bottle neck. Accordingly, the separation of the cap element from the ring element upon a first time opening of the bottle does not violate the Sabbath.

FIGS. 1-4 illustrate one embodiment of the bottle closure of the present invention, and is generally designated by 10. In this embodiment, bottle closure 10 comprises three components: cap element 1, sleeve element 2, and ring element 5. These three components may be made of any desired material such as a plastic material or a metallic material, although it may be desirable that ring element 5 be made of a flexible material, such as a plastic material.

Figure 1:
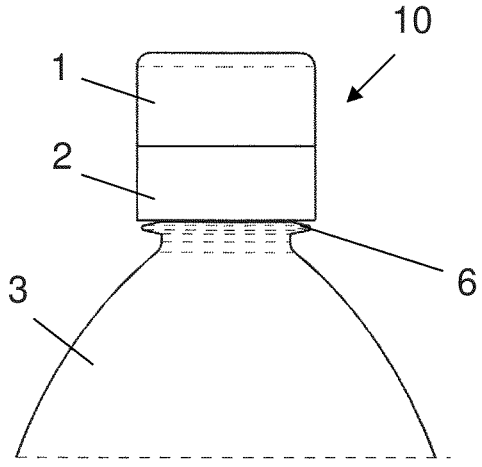
FIG. 1 is a schematic side view of a bottle closure according to one embodiment of the present invention as it is in sealing relation with the neck of a bottle.

FIG. 1 illustrates bottle closure 10 as it is in sealing relation with the neck of bottle 3 whereby sleeve element 2 engaged with both cap element 1 and with the internal ring element (not shown) is located above annular base flange 6 extending radially outwardly from the bottle neck while the ring element is engaged with an annular locking bead of the bottle, which is located above annular flange 6.

Figure 2:
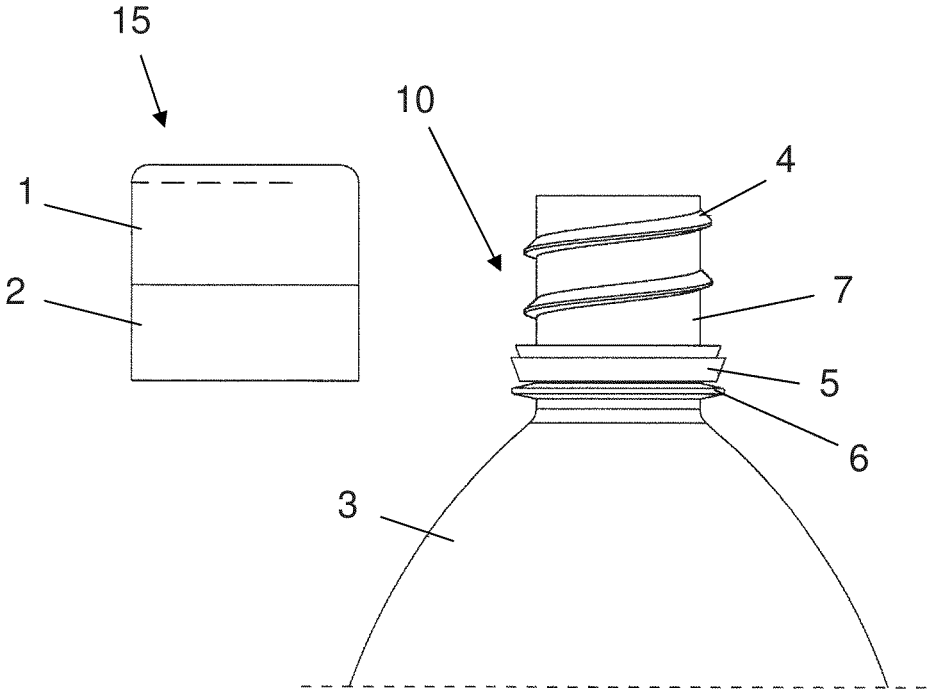
FIGS. 2 and 3 are schematic side and perspective views, respectively, of a cap unit following a first time opening of a bottle, showing a ring element remaining in affixed relation with respect to a bottle neck.
Figure 3:
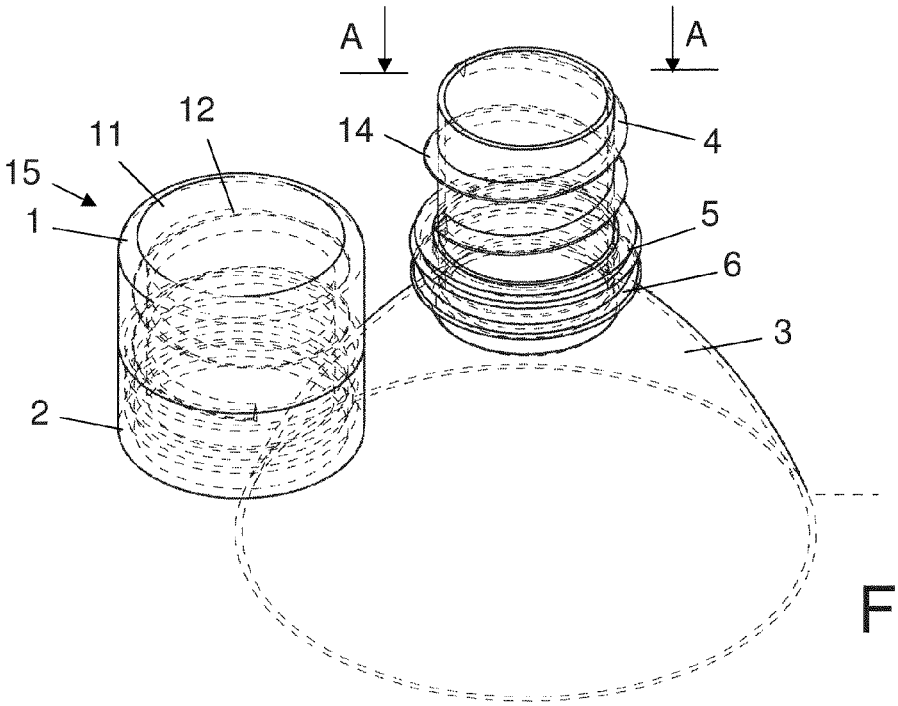

Upon unscrewing bottle closure 10 following a first time opening as shown in FIGS. 2 and 3, the coupled cap and sleeve unit 15 becomes separated from ring element 5 while the latter remains affixed to neck 7 of bottle 3 above flange 6 and below bead 14, indicating that the closure has been tampered with or has been previously opened. The inner threads 12 formed within the inner cylindrical surface 11 of cap element 1 are adapted to engage the helical threads 4 formed along the outer surface of bottle neck 7, allowing cap and sleeve unit 15 to seal again bottle neck 7.

Figure 4A:
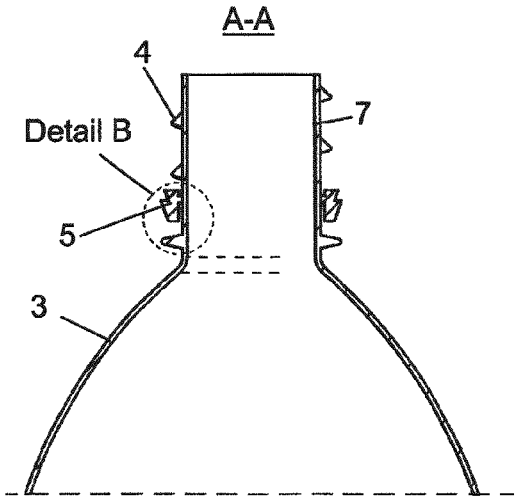
FIG. 4*a* is a vertical cross sectional view of a bottle neck, cut along plane A-A of FIG. 3.
Figure 4B:
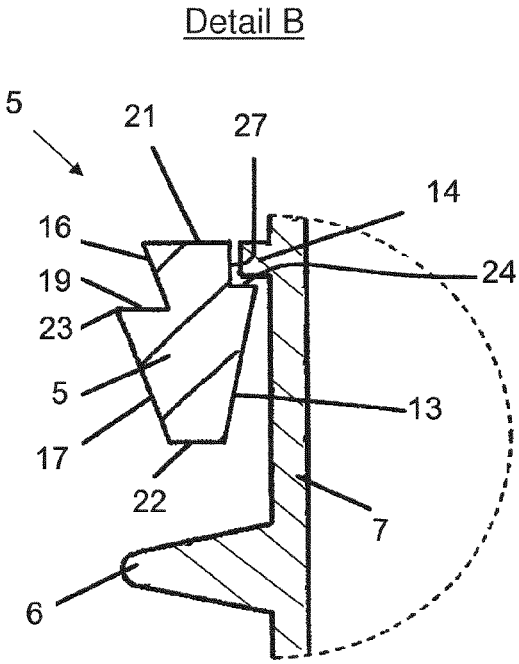
FIG. 4*b* is enlargement of FIG. 4*a*, illustrating a configuration of a ring element according to one embodiment of the present invention.

FIG. 4*a* is a vertical cross sectional view of a bottle neck 7 to which is affixed ring element 5, after the coupled cap and sleeve unit has become separated therefrom. As shown in FIG. 4*b*, which is an enlargement of FIG. 4*a*, ring element 5 is engageable with a locking bead 14 extending radially from bottle neck 7.

Ring element 5 is configured with an upper inclined outer surface 16 sloping upwardly and outwardly, a lower inclined outer surface 17 substantially parallel to surface 16, and a substantially horizontal surface 19 extending between surfaces 16 and 17. Lower inclined outer surface 17 and horizontal surface 19 coincide at an apex 23 which enables engagement with the sleeve element. Ring element 5 also has an inner inclined surface 13 sloping upwardly and inwardly from a lower substantially horizontal surface 22 that extends from lower outer surface 17, a horizontal surface 24 extending radially inwardly from the upper edge of surface 13, a substantially vertical surface 27 extending from horizontal surface 24, and an upper substantially horizontal surface 21 extending from upper outer surface 16 to vertical surface 27. Locking bead 14 of bottle neck 7 is adapted to be seated on top of horizontal surface 24 and to be in contact with vertical surface 27.

Bottle closure 10 is lowered onto bottle neck 7 when it is placed in tamper evident engagement therewith for the first time. Flexible ring element 5 becomes plastically deformed when inclined surface 13, which protrudes inwardly from vertical surface 27, slides over locking bead 14 when bottle closure 10 is lowered onto bottle neck 7 while the cap element is being screwed onto threads 4 of the bottle neck until horizontal surface 24 of the ring element is positioned below bead 14. Since the cap element is coupled to ring element 5 such that a bottom surface of the cap element is placed in abutting relation with upper horizontal surface 21 of the ring element, both upper and lower displacement of ring element 5 are prevented. After the cap unit is unscrewed for the first time, however, the cap element ceases to be coupled to the ring element and the latter is movable between bead 14 and flange 6, serving as an indication that the cap unit has been unscrewed.

Figure 5A:
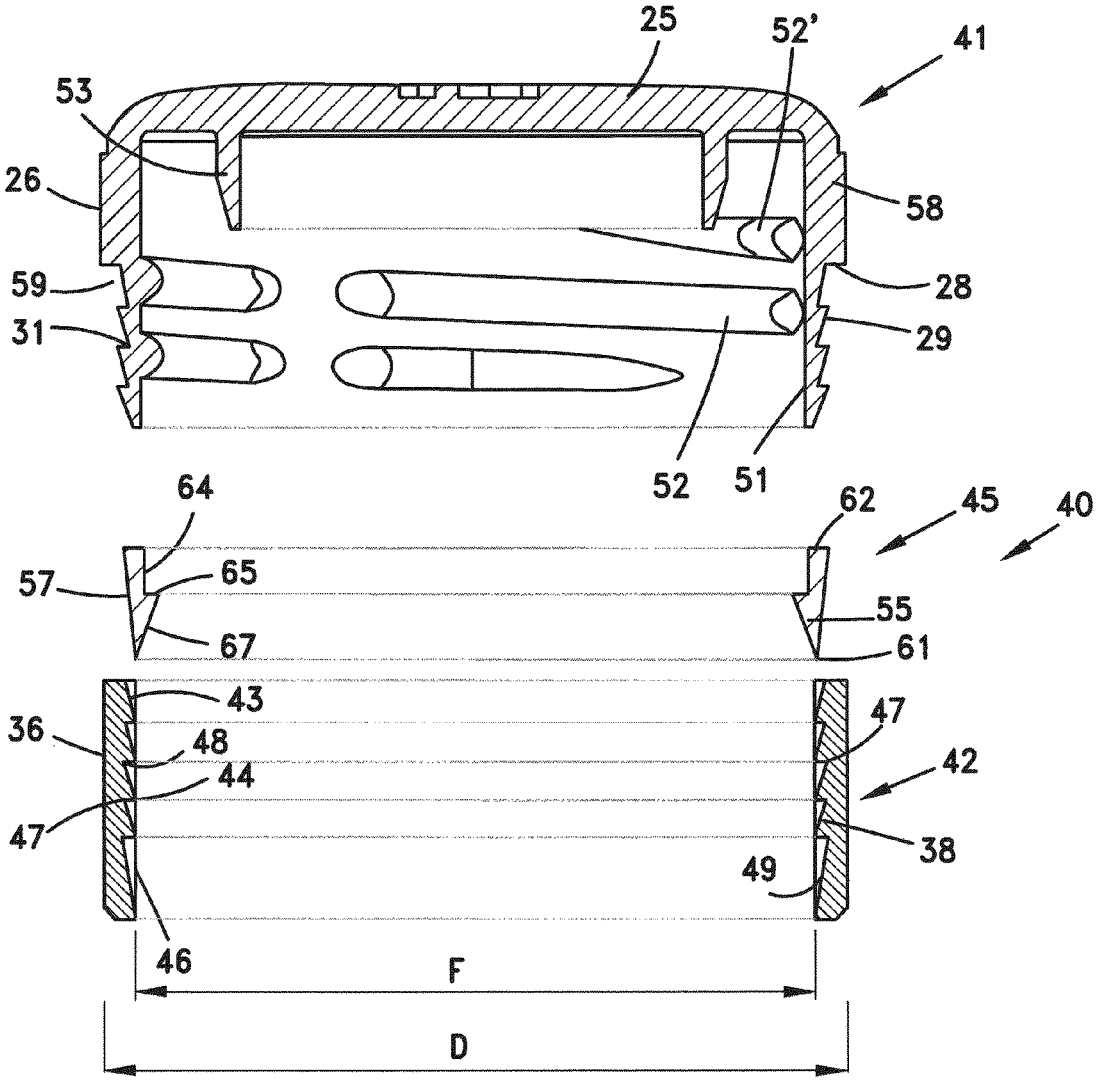
FIG. 5*a* is a vertical cross sectional view of a bottle closure in an exploded arrangement, according to one embodiment of the present invention.
Figure 5B:
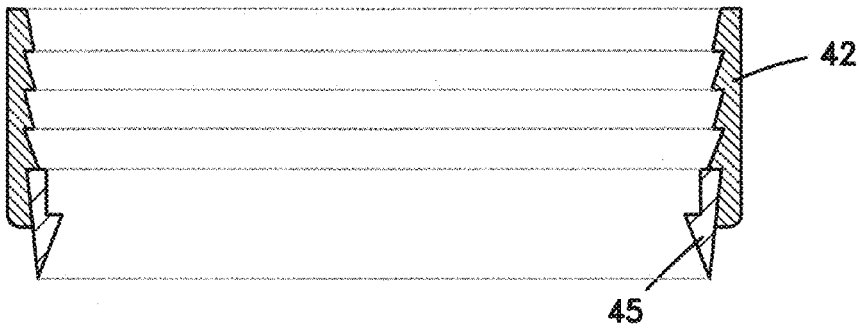
FIG. 5*b* is a vertical cross sectional view of the bottle closure of FIG. 5*a*, showing a ring element and sleeve element when coupled together.
Figure 5C:
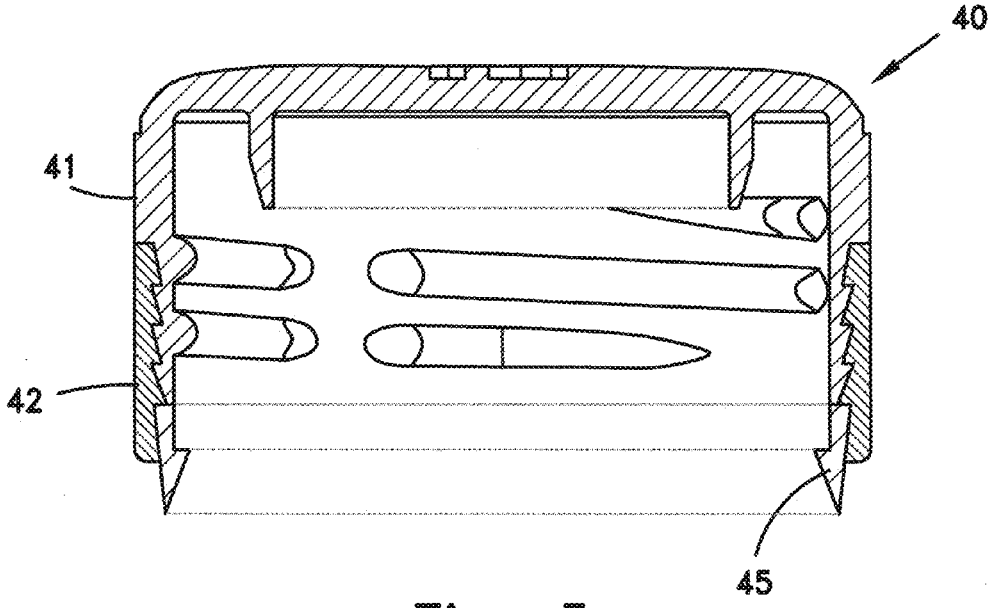
FIG. 5*c* is a vertical cross sectional view of the bottle closure of FIG. 5*a*, shown in an assembled arrangement.

FIGS. 5*a*-*c* illustrate a method for assembling a bottle closure 40 wherein FIG. 5*a* illustrates the three components of the bottle closure in an exploded arrangement, FIG. 5*b* illustrates the sleeve element and ring element when coupled together, and FIG. 5*c* illustrates the bottle closure in an assembled arrangement.

In addition to inner threads 52 formed within inner surface 51 of wall 58, cap element 41 is also configured with a upper surface 25 and with a plurality of circumferentially extending and inclined notches 59, which are recessed from the outer surface 26 of wall 58 and arranged such that an upper notch is more inwardly recessed than a notch located immediately therebelow. Each notch 59 is defined by an upper horizontal surface, a lower horizontal surface, and by a downwardly inclined planar wall 29 extending between the upper and lower surfaces in a direction towards inner surface 51 of wall 58. For example, the uppermost horizontal surface 28 extends inwardly from outer surface 26, at a height corresponding approximately to that of the uppermost thread 52', to the upper edge of the uppermost inclined wall 29. A horizontal surface 31 extends outwardly from the bottom edge of the uppermost inclined wall to the top edge of the inclined wall located immediately therebelow. Each of the plurality of inclined walls 29 is mutually parallel.

Cap element 41 also has a seal ring 53, which downwardly extends from upper surface 25 and is adapted to abut the free end of the bottle neck when the latter is fully engaged with threading 52 and to thereby prevent the escape of diffused gases from a beverage stored in the bottle. Seal ring 53 extends downwardly from the underside of upper surface 25 and is concentric with outer surface 26.

Sleeve element 42 has a cylindrical outer surface 36 having an outer diameter D which is essentially equal to that of outer surface 26 of cap element wall 58. From sleeve element outer surface 36 inwardly protrude a plurality of vertically spaced and circumferentially extending engagement elements 38 of triangular cross section. Each engagement element is defined by the lower edge of an inclined surface 43 and by the inner edge of a horizontal surface 48 which coincide at an apex 44. The apex 44 of each of the engagement elements defines a serrated edge 46 having an inner diameter F. The outer edge of horizontal surface 48 coincides with the upper edge of a corresponding inclined surface 43 to define a contact region 47. A lowermost engagement element has an inclined surface 49 that is at least twice as long as the inclined surface 41 of the other engagement elements.

Wall 55 of ring element 45 has an outer inclined surface 57 that slopes upwardly from bottom edge 61 to upper edge 62 such that its diameter at bottom edge 61 is approximately equal to F while its outer diameter at upper edge 62 is greater than F. Upper inner surface 64 of ring element 45 extends substantially perpendicularly and downwardly from upper edge 62, which has an inner diameter substantially equal to the outer diameter of bead 14 extending radially from bottle neck 7 (FIG. 4*b*) so as to be in contact therewith. Ring element 45 also has a lower inner inclined surface 67 that slopes upwardly and inwardly from bottom edge 61, and a horizontal surface 65 that extends from the upper edge of surface 67 to the bottom edge of surface 64.

Bottle closure 40 is assembled externally to the bottle. Ring element 45 is first positioned above sleeve element 42 and then lowered into the interior of sleeve element 42. Since the upper edge of ring element 45 has a larger outer diameter than serrated edge 46 of sleeve element 45, flexible ring element wall 55 will become compressed by each serrated edge apex 44 when ring element 45 is lowered thereagainst Ring element wall 55 will then return to its original dimensions after it is lowered below the lowermost apex 44, remaining in abutting relation with inclined surface 49 of the lowermost engagement element, as shown in FIG. 5*b*. Once ring element wall 55 is placed in abutting relation with inclined surface 49, the ring element cannot be removed upwardly from sleeve element 42 due to the intervention of the inwardly protruding apices 44.

Cap element 41 is then lowered towards ring element 45 so that each inclined planar wall 29 thereof progressively and ratchedly slides against the inclined surfaces 43 of sleeve element 42. When cap element 41 is completely lowered, as shown in FIG. 5*c*, each engagement element 38 of sleeve element 42 is received in a corresponding notch 59 of cap element 41, uppermost horizontal surface 28 of cap element 41 contacts the uppermost horizontal surface 48 of sleeve element 42, and lowermost horizontal surface 28 of cap element 41 contacts upper edge 62 of ring element 45.

Figure 6:
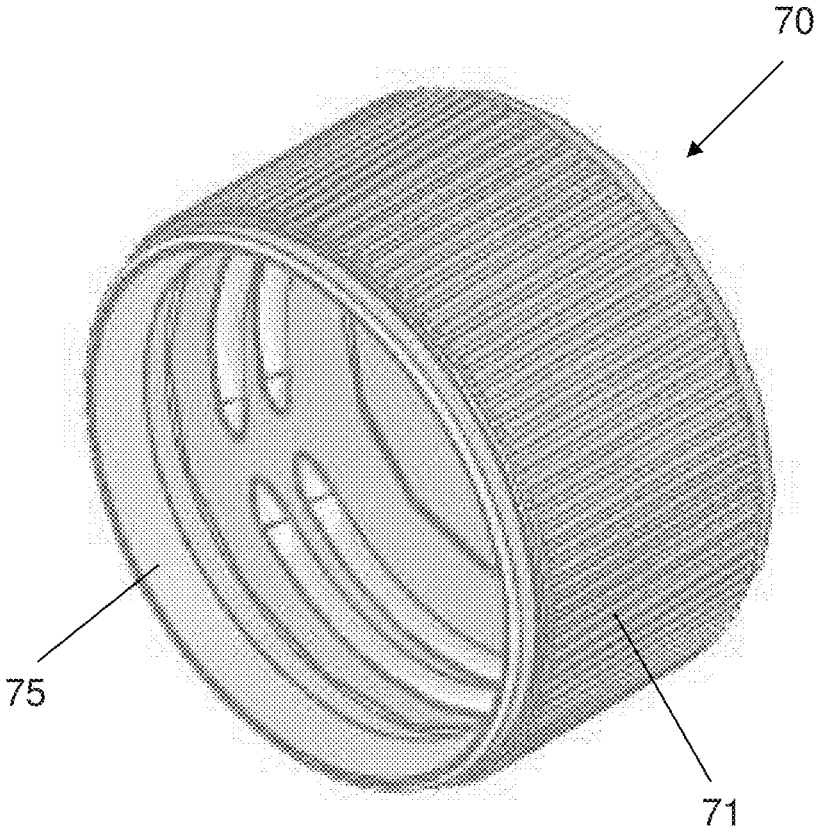
FIG. 6 is a perspective view of a bottle closure according to another embodiment of the present invention.

FIG. 6 illustrates another embodiment of a bottle closure, which is generally designated by 70. In this embodiment, bottle closure 70 comprises two components: cap element 71 and ring element 75 which is coupled to, and slightly inwardly recessed from, cap element 71.

Figure 7A:
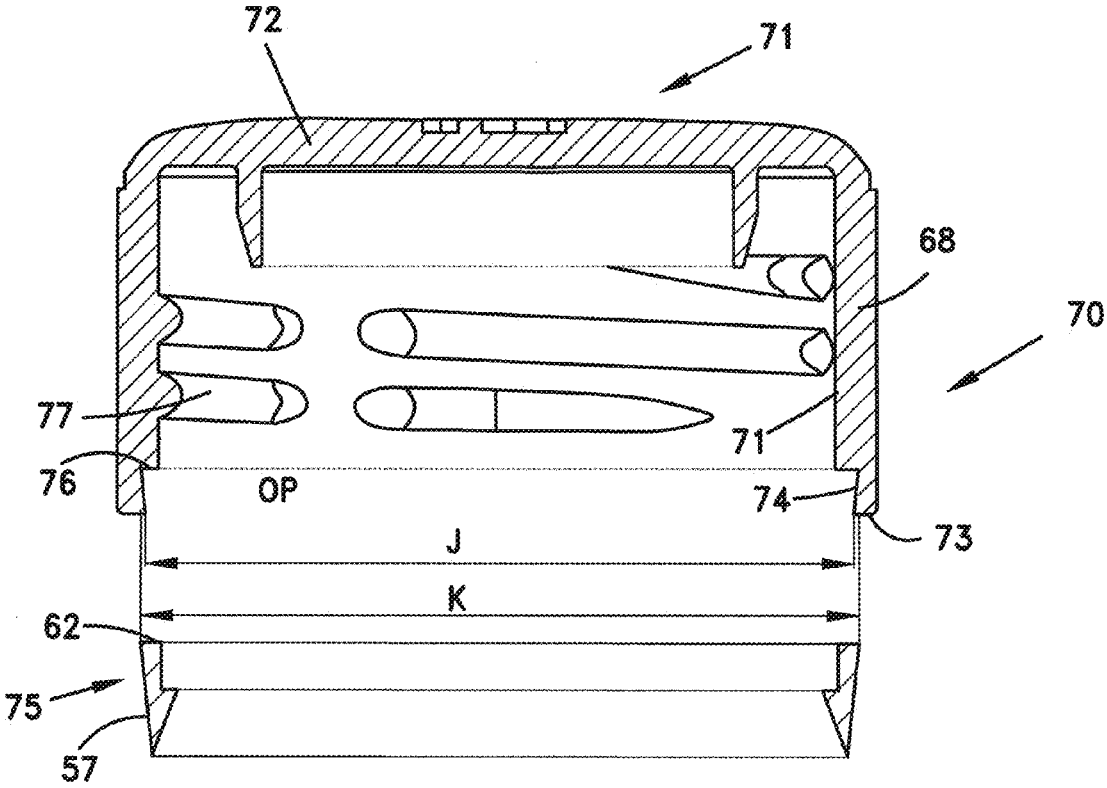
FIG. 7*a* is a vertical cross sectional view of the bottle closure of FIG. 6 in an exploded arrangement.

As shown in FIG. 7*a*, ring element 75 is configured similarly to ring element 45 of FIG. 5*a* so as to be in temporary fixed engagement with the locking bead of a bottle neck.

Cap element 71 has an upper surface 72 and a wall 68 substantially perpendicular to upper surface 72, and within the inner surface 71 of wall 68 are formed inner threads 77. Bottom surface 73 of wall 68 is significantly thinner than the maximum thickness of the latter near the vicinity of upper surface 72, in order to accommodate the upward insertion of ring element 75. An inclined surface 74 slopes upwardly and outwardly from the inner edge of bottom surface 73, and a horizontal surface 76 extends from the upper edge of inclined surface 74 to inner surface 71 of wall 68. The length of horizontal surface 76 is substantially equal to the length of upper edge 62 of ring element 75, and the inclination of outer surface 57 of ring element 75 is substantially equal to that of surface 74 of cap element 71.

Figure 7B:
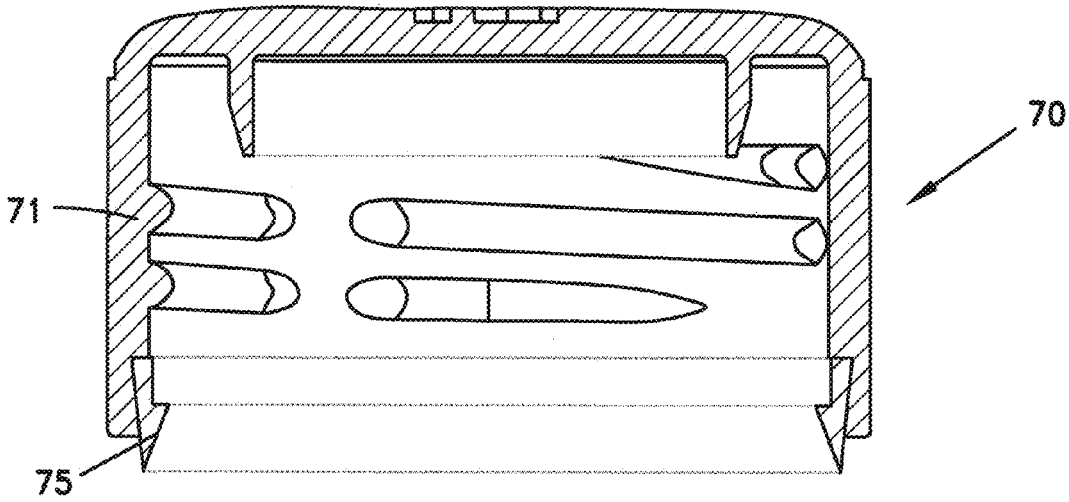
FIG. 7*b* is a vertical cross sectional view of the bottle closure of FIG. 6, shown in an assembled arrangement.

Although the maximum outer diameter K of ring element 75 is greater than the inner diameter J of bottom surface 73 of cap element 71, ring element 75 is able to be coupled to cap element 71 according to any means well known to those skilled in the art when displaced towards upper surface 72. For example, ring element 75 may be temporarily compressed by suitable mechanical apparatus until its outer diameter is less than J, to allow ring element 75 to be inserted within the opening OP defined by inclined circumferentially extending surface 74. Ring element 71 will then expand to its maximum outer diameter K after being inserted in opening OP and being released from the compressing apparatus, allowing outer surface 57 and upper edge 62 of ring element 75 to be engaged by inclined surface 74 and horizontal surface 76, respectively, of cap element 71, as shown in FIG. 7*b*. After ring element 75 of a coupled closure has been affixed to a bottle neck and cap element 71 has been unscrewed for the first time, the ring element remains loosely affixed to the bottle neck. Since the affixed ring element cannot be compressed in order to be inserted into a cap element due to the presence of the bottle neck, the presence of a loosely affixed ring element positively indicates that the bottle has been tampered with or has been opened.

Alternatively, cap element 71 may be heated to widen opening OP, allowing ring element 75 sufficient clearance to be inserted into opening OP. Thus when cap element 71 becomes subsequently cooled, outer surface 57 and upper edge 62 of ring element 75 will be engaged by inclined surface 74 and horizontal surface 76, respectively, of cap element 71. It will be appreciated that the application of heat causes the widening of cap element 71 and enables the subsequent engagement of the cap element and ring element. The application of heat, however, does not cause cap element 71 and ring element 75 to fuse together. Accordingly, cap element 71 and ring element 75 are considered to be two separate components even when coupled together. Thus the unscrewing of cap element 71 during a first time opening of the bottle, after the bottle closure has been threadedly engaged with the bottle neck and ring element 75 has been secured to the locking bead, will not effectuate the cap element into a usable tool since it has been able to seal a bottle neck after being manufactured.

It will also be appreciated that a bottle closure comprising a cap element that has been heat widened externally to a bottle and a ring element that has been secured to a locking bead of the bottle positively indicates whether the bottle has been tampered with or has been opened. Prior to a first time opening of the bottle, the ring element is secured to the bead and cannot be raised or lowered. After the first time opening, the ring element remains affixed to the bottle neck, but it is movable between the bead and the annular flange therebelow. Even though the cap element can be heated and widened again to allow engagement with the ring element while the latter remains affixed to the bottle neck, a heat widened cap element nevertheless cannot seal the bottle neck due to the separation of the inner threads 77 (FIG. 7*a*) of the cap element from bottle neck threads 4 (FIG. 2) and the resulting inability to threadedly engage the cap element to the bottle neck as a result of the increased diameter of cap element wall 68, and also due to the increased diameter of seal ring 53 relative to the diameter of the bottle neck. Thus the bottle closure of the present invention that comprises a heat widened cap element is also tamper evident.

Ring element 75 may be made from a material or a color dissimilar to that of cap element 71 in order to visually emphasize the decoupling of the cap element from the ring element, which is indicative of tamper or spoilage of the product stored in the bottle.

If so desired, ring element 75 may be made of a temperature sensitive material which will be damaged, disintegrate, or become discolored if the temperature of the stored product, e.g. wine, exceeds a predetermined temperature.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A tamper-evident bottle closure complying with the regulations of the Jewish Sabbath, comprising:

(a) a ring element affixable to a bottle neck having an annular locking bead and an annular flange located below said bead and extending radially outwardly from said bottle neck; and (b) a cap unit manufactured separately from said ring element and which is coupled with said ring element externally to a bottle, wherein said ring element of a coupled closure is affixable to said bottle neck prior to a first time opening of the bottle to retain a contained product in a confirmed sealed condition, yet said cap unit is irreversibly separable from said ring element when unscrewed for a first time to indicate that the bottle has been opened;

wherein a maximum outer diameter of said ring element is greater than an inner diameter of a cap unit bottom surface, wherein an outer sloped wall of said ring element is engageable with an inner sloped wall of said cap unit, said inner sloped wall of said cap unit having a substantially equal inclination as that of said outer sloped wall of said ring element, wherein said ring element is also configured with an inner sloped wall and with a substantially horizontal surface that extends from an upper edge of said inner sloped wall, said inner sloped wall being slidable over the locking bead of said bottle neck when the coupled bottle closure is being lowered onto said bottle neck while the cap unit is being threadedly engaged with said bottle neck until said substantially horizontal surface of the ring element is in abutting relation with an underside of the bead.

2. The closure according to claim 1, wherein the ring element is compressible to enable engagement with the cap unit externally to the bottle but resists compression when affixed to the bottle neck.

3. The closure according to claim 1, wherein the cap unit is expandable upon application of heat thereto to enable engagement with the ring element externally to the bottle.

4. The closure according to claim 1, wherein the ring element is in temporary fixed engagement with the locking bead when the substantially horizontal surface of the ring element is placed in abutting relation with the underside of the bead.

5. The closure according to claim 4, wherein the ring element is movable between the bead and the flange after the cap unit has been unscrewed for the first time.

6. The closure according to claim 1, wherein the cap unit is also configured with an upper surface and a circumferential wall extending downwardly and substantially perpendicularly from said upper surface to a bottom surface which is located below the inner sloped wall of the cap unit.

7. The closure according to claim 6, wherein the cap unit is also configured with a substantially horizontal surface inwardly extending from an upper edge of the inner sloped wall, said substantially horizontal surface being engageable with an upper surface of the ring element.

8. The closure according to claim 6, wherein the ring element is made of a flexible or temperature sensitive material.

9. The closure according to claim 6, wherein the ring element is made from a material or a color dissimilar to that of the cap element.

10. The closure according to claim 1, wherein the ring element is made of a flexible material.

11. The closure according to claim 1, wherein the ring element is made of a temperature sensitive material.

12. The closure according to claim 1, wherein the ring element is made from a material or a color dissimilar to that of the cap element.

13. A tamper-evident bottle closure complying with the regulations of the Jewish Sabbath, comprising:

(a) a ring element affixable to a bottle neck having an annular locking bead and an annular flange located below said bead and extending radially outwardly from said bottle neck; and (b) a cap unit manufactured separately from said ring element and which is coupled with said ring element externally to a bottle, wherein said ring element of a coupled closure is affixable to said bottle neck prior to a first time opening of the bottle to retain a contained product in a confirmed sealed condition, yet said cap unit is irreversibly separable from said ring element when unscrewed for a first time to indicate that the bottle has been opened, wherein a maximum outer diameter of said ring element is greater than an inner diameter of a cap unit bottom surface, wherein an outer sloped wall of said ring element is engageable with an inner sloped wall of said cap unit, said inner sloped wall of said cap unit having a substantially equal inclination as that of said outer sloped wall of said ring element, wherein the said cap unit comprises a cap element and a sleeve element engaged with said cap element, said outer sloped wall of said ring element being engaged with an inner sloped wall of said sleeve unit.

14. The closure according to claim 13, wherein the sleeve element is configured with a serrated edge above the inner sloped wall and the outer sloped wall of the ring element is compressed by said serrated edge when the ring element is lowered into engagement with the inner sloped wall of the sleeve unit externally to the bottle.

15. The closure according to claim 14, wherein the sleeve element is also configured with a plurality of vertically spaced, inwardly protruding, and circumferentially extending engagement elements of triangular cross section, an apex of each of said engagement elements defining the serrated edge.

16. The closure according to claim 15, wherein the cap element is also configured with an upper surface, a circumferential wall extending downwardly and substantially perpendicularly from said upper surface, and a plurality of circumferentially extending and inclined notches which are recessed from an outer surface of said wall and arranged such that an upper notch is more inwardly recessed than a notch located immediately therebelow, each engagement element of the sleeve element being received in a corresponding notch upon progressive and ratched displacement of an inclined wall of each of said notches against a corresponding inclined surface of an engagement element.

17. The closure according to claim 16, wherein a lowermost surface of the cap element contacts an upper edge of the ring element after the cap element is completely displaced with respect to the sleeve element.

18. The closure according to claim 13, wherein the ring element is made of a flexible material.

19. The closure according to claim 13, wherein the ring element is made of a temperature sensitive material.

20. The closure according to claim 13, wherein the ring element is made from a material or a color dissimilar to that of the cap element.

* * * * *